US006497330B1

(12) United States Patent
Van Der Linden et al.

(10) Patent No.: US 6,497,330 B1
(45) Date of Patent: Dec. 24, 2002

(54) CARRIER SUBSTRATE

(75) Inventors: Petrus J. C. C. Van Der Linden, Eindhoven (NL); Jan P. Meijer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/460,939

(22) Filed: Dec. 14, 1999

(30) Foreign Application Priority Data

Dec. 14, 1998 (EP) ..... 98204235

(51) Int. Cl.[7] ..... A47F 7/00
(52) U.S. Cl. ..... 211/133.6; 432/261; 445/47
(58) Field of Search ..... 211/133.6; 220/4.34, 220/552; 432/261; 445/47

(56) References Cited

U.S. PATENT DOCUMENTS 2,710,746 A * 6/1955 Menough
2,765,159 A * 10/1956 Garofalo
2,877,008 A * 3/1959 DeMattia et al.
3,092,375 A * 6/1963 Bixby
3,156,456 A * 11/1964 Menough
4,290,753 A * 9/1981 Klefisch ..... 432/261
4,427,396 A * 1/1984 VandenBerg ..... 445/47
4,431,408 A * 2/1984 Postich ..... 432/261
4,463,864 A * 8/1984 Roach
4,669,978 A * 6/1987 Klefisch ..... 432/261
5,752,821 A * 5/1998 Jo ..... 432/261

FOREIGN PATENT DOCUMENTS

| | | |
|---|---|---|
| DE | 514070 | 11/1930 |
| EP | 0015373 | 2/1979 |
| EP | 0106989 | 9/1982 |
| GB | 2092920 | 2/1981 |
| JP | 5291004 | 2/1979 |
| JP | 53145900 | 5/1980 |

* cited by examiner

*Primary Examiner*—Robert W. Gibson, Jr.

(57) ABSTRACT

A carrier substrate for carrying objects subjected to elevated temperatures comprises at least a grid part and a border part. The grid part includes grid elements having end portions provided with holes. The end portions partly extend outside the border part via sleeves in the border part. The grid elements and the border part are interconnected solely by interengaging connection portions comprising the first end portions and metal wires extending through the holes.

3 Claims, 2 Drawing Sheets

CARRIER SUBSTRATE

BACKGROUND OF THE INVENTION

The invention relates to a carrier substrate for carrying objects subjected to elevated temperatures, the carrier substrate comprising at least a grid part and a border part.

The invention also relates to a method of manufacturing a selection electrode for a color cathode ray tube, said selection electrode comprising a shadow mask blank having a pattern of apertures, the method comprising the steps of providing patterns of apertures in a steel foil, cutting mask blanks from the steel foil, and annealing a stack of mask blanks at an elevated temperature, in which annealing step a carrier substrate of the above-mentioned type is used.

A carrier substrate for carrying objects subjected to elevated temperatures is known. In U.S. Pat. No. 4,427,396 a carrier substrate is described for use during an annealing step of mask blanks. Several manufacturing steps transform the mask blanks finally into selection electrodes for color Cathode Ray Tubes. To facilitate the subsequent deep drawing and obtain a grain size for good magnetic screening by the shadow mask, an annealing process is carried out on the blanks. To this end, a stack of blanks is placed on a carrier substrate and subjected to temperatures in the range of 600 to 880° C. It appears that the lifetime of such carrier substrates is limited due to permanent deformation of the carriers occurring after several temperature cycles.

OBJECTS AND SUMMARY OF THE INVENTION

It is an object of the invention to provide a carrier substrate that has an improved lifetime.

A first aspect of the invention is characterized in that the carrier substrate comprises elements that are interconnected solely by interengaging connection portions.

Carrier substrates according to the state of the art comprise parts that are often connected to each other by welding or a similar connection technique. At elevated temperatures, the connection points appear to be sensitive to internal thermal stress, which leads to permanent deformation of the carrier substrate. The inventors have realized that internal stresses may be reduced by creating a connection without any additional connection means.

DESCRIPTION OF THE PREFERRED EMBODIMENTS

An embodiment of the invention provides a way of connecting elements to each other to result in a rigid frame that has as an additional advantage that the separate elements are easily replaced in case the frame needs to be repaired.

A further embodiment of the invention has the advantage that a rigid frame is obtained in which repair may easily take place.

A further embodiment of the carrier substrate according to the invention further improves the rigidity of the frame.

An embodiment of the invention further provides a proper selection of materials, which have a high yield strength, if the carrier substrate comprises a material selected from the group of materials molybdenum, tungsten, austenitic steel, ceramics or alloys of nickel and iron. Good results were obtained.

A second aspect of the invention provides a method of manufacturing a selection electrode for a color cathode ray tube, said selection electrode comprising a shadow mask blank having a pattern of apertures, the method comprising the steps of providing patterns of apertures in a steel foil, cutting shadow mask blanks from the steel foil, and annealing a stack of shadow mask blanks at an elevated temperature, in which annealing step a carrier substrate is used for carrying the shadow mask blanks, said carrier substrate comprising at least a grid part and a border part, characterized in that said carrier substrate comprises elements that are interconnected solely by interengaging connection portions.

BRIEF DESCRIPTION OF THE DRAWINGS

These and other aspects of the invention are apparent from and will be elucidated with reference to the embodiments described hereinafter.

In the drawings:

In general, like reference numerals identify like elements.

FIG. 1 shows a carrier substrate 1 according to the invention, comprising a grid part 2 and a border part 3, which are interconnected solely by interengaging connection portions 5,6.

The grid part 2 comprises grid elements 7, which are interconnected via interengaging connection portions of a first type 5. In this way, no additional connection methods, such as welding, are required for constructing the grid part 2 and it results in a carrier substrate 1 with a shape which remains unchanged after many temperature cycles. The lifetime of the carrier substrate 1 is further increased by constructing it from materials having a high yield strength. Good results were obtained with materials selected from the group of materials molybdenum, tungsten, austenitic steel, ceramics or alloys of nickel and iron.

Figure 1:
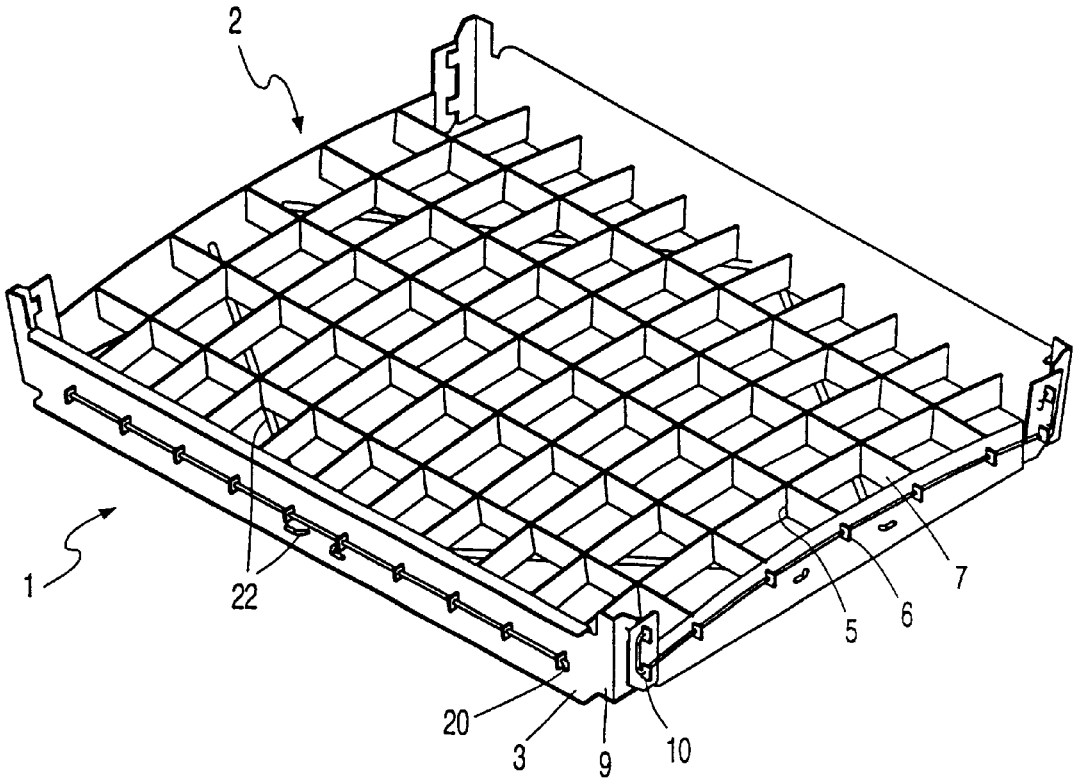
FIG. 1 is an elevational view of a substrate carrier according to the invention.

FIG. 1 further shows an embodiment of the invention in which also the border part 3 comprises border elements 9 which are interconnected via sleeves 10. It is also possible to construct the border part 3 from a single piece.

The carrier substrate 1 is designed in such a way that the substrates 1 may be stacked very easily.

The border part 3 is provided with metal wires 22, which extend between two different sides to give the carrier substrate 1 additional rigidity.

Figure 2:
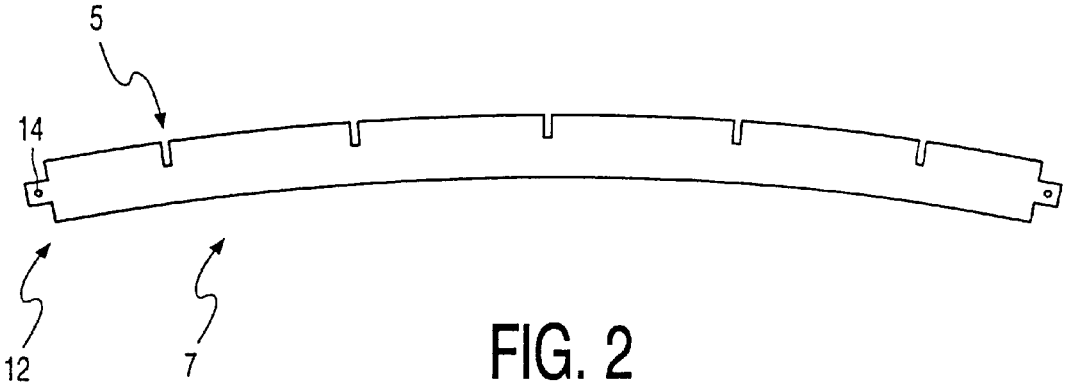
FIG. 2 is a side view of a grid element according to the invention.

FIG. 2 is a side view of a grid element 7 according to the invention. It comprises interengaging connection portions 5 of a first type consisting of sleeves 5. The grid elements 7 are interconnected solely by cooperation of the sleeves 5.

The grid element 7 has a longitudinal direction and a widthwise direction. The grid element 7 comprises end portions 12 extending in the longitudinal direction, which are provided with holes 14 perpendicular to the longitudinal direction and the widthwise direction.

Figure 3:
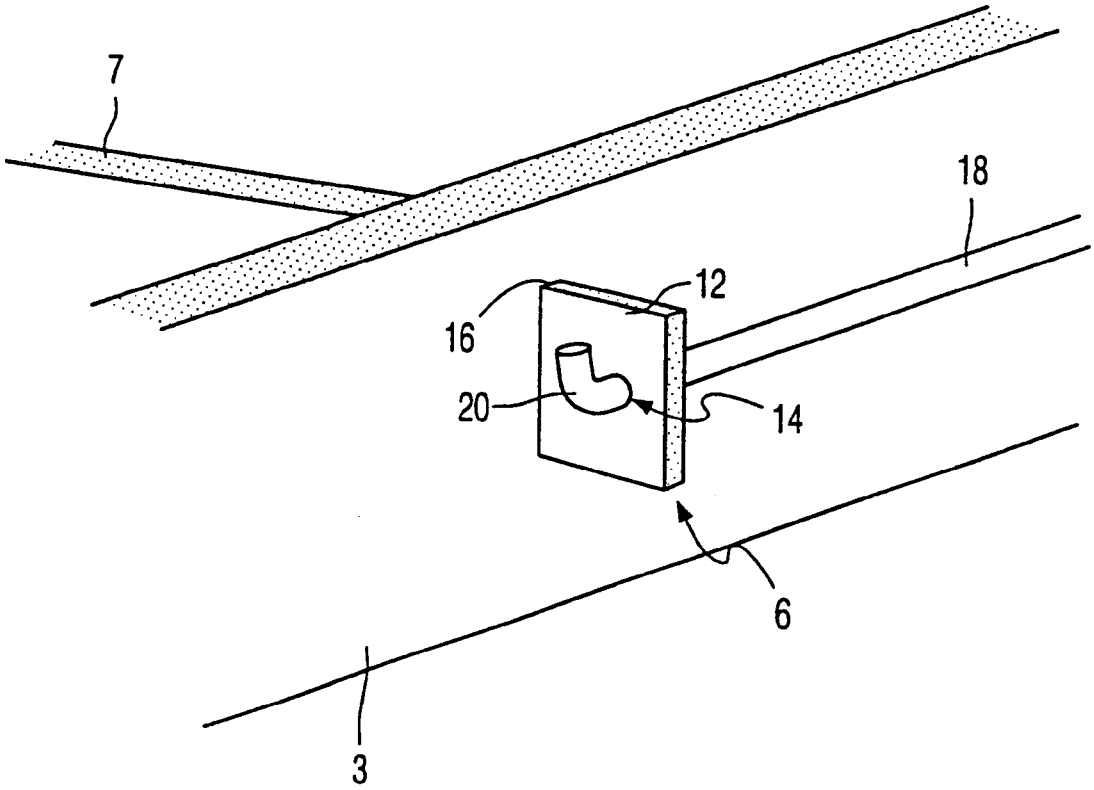
FIG. 3 an elevational cross-section of a border part of the carrier substrate according to the invention.

FIG. 3 is an elevational cross-section of a border part 3 of the carrier substrate 1 comprising interengaging connection portions 6 of a second type. End portions 12 of the grid elements 7 extend partly through sleeves 16 which are provided in the border part 3. Metal wires 18 extending through the holes 14 comprise bended end portions 20 for fixing the wires 18 to the carrier substrate 1.

In summary, the invention relates to a carrier substrate 1 for carrying objects subjected to elevated temperatures, in particular for annealing processes as used in the manufacture of shadow masks for a cathode ray tube. By constructing the carrier substrate 1 with interengaging connection portions 5,6, no additional connection methods are required. This leads to a carrier substrate 1 with a shape which remains unchanged after many temperature cycles. The lifetime of the carrier substrate 1 can be further increased by constructing it from materials selected from the group of materials molybdenum, tungsten, austenitic steel, ceramics or alloys of nickel and iron.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim.

What is claimed is:

1. A carrier substrate for carrying objects subjected to elevated temperatures, said carrier substrate comprising at least a grid part and a border part, the grid part including grid elements having first end portions provided with holes, said first end portions partly extending outside the border part via sleeves in the border part, and said grid elements and said border part being interconnected solely by interengaging connection portions comprising said first end portions and first metal wires extending through the holes.

2. A carrier substrate according to claim 1, wherein said first metal wires comprise bended end portions for fixing the first metal wires to the carrier substrate.

3. A carrier substrate according to claim 1, characterized in that the border part has sides and is provided with second metal wires, each second metal wire extending between two different ones of said sides.

* * * * *